United States Patent [19]

Guandalini et al.

[11] Patent Number: 4,575,283

[45] Date of Patent: Mar. 11, 1986

[54] DEVICE AND PROCESS FOR MAKING UNCLAD CONCRETE PILES

[76] Inventors: Claudio Guandalini, Viale Stefano Franscini 43, 6500 Bellinzona, Switzerland; Fausto Massari, Via Regina Elena 5, 04016 Sabaudia Latina, Italy

[21] Appl. No.: 558,555

[22] Filed: Dec. 5, 1983

[30] Foreign Application Priority Data

Dec. 6, 1982 [CH] Switzerland ..... 7064/82

[51] Int. Cl.[4] ..... E02D 5/34

[52] U.S. Cl. ..... 405/240; 405/233; 405/236

[58] Field of Search ..... 405/240, 239, 241, 242, 405/243, 233, 236

[56] References Cited

U.S. PATENT DOCUMENTS

| | | | |
|---|---|---|---|
| 2,555,951 | 6/1951 | Allard | 405/243 |
| 2,649,694 | 8/1953 | Pickman | 405/240 |
| 3,164,963 | 1/1965 | Talley et al. | 405/243 |
| 3,206,935 | 9/1965 | Phares | 405/242 |
| 3,881,320 | 5/1975 | Gendron | 405/242 |
| 4,152,089 | 5/1979 | Stannard | 405/240 X |
| 4,295,759 | 10/1981 | Mathieu et al. | 405/243 |

FOREIGN PATENT DOCUMENTS

| | | | |
|---|---|---|---|
| 751808 | 6/1933 | France | 405/240 |

*Primary Examiner*—Dennis L. Taylor

*Attorney, Agent, or Firm*—Young & Thompson

[57] ABSTRACT

The device comprises:

- a beating cap (1) provided with a conduit (2) for introduction of the concrete under pressure;
- a pipe form (3) to be sunk and pulled out gradually as the concrete is introduced, the pipe form having a fastening (4) connected to a pressure gauge (4') for reading of the pressures acting on the concrete;
- a chuck (5) located between the pipe form (3) and having a conduit for passage of the concrete (2) under pressure and a cylindrical sheath (6) for reducing volume;
- two expandable tubular rings (7,7') to make a seal for the air under pressure in the air chamber (8) between the pipe form (3) and the chuck (5) to achieve locking between the chuck (5), the pipe form (3) and the beating cap (1);
- a one-time bottom (9) to prevent penetration of dirt in the pipe form during sinking;

The raising of the pipe form (3) gradually as the concrete is introduced being facilitated by the pressure that is exerted in air chamber (8) by the effect of the introduction of the concrete.

6 Claims, 1 Drawing Figure

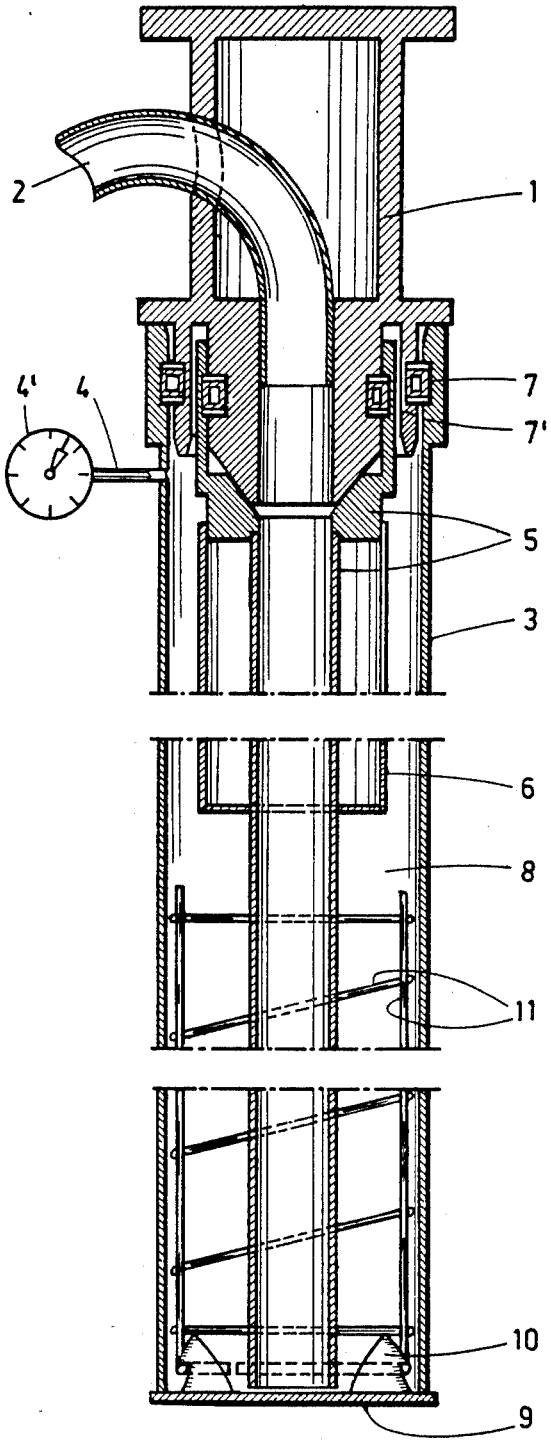
2
1
4'
4
7
7'
5
3
6
8
11
10
9

DEVICE AND PROCESS FOR MAKING UNCLAD CONCRETE PILES

This invention has as its object a device for making unclad piles and a process for using the device.

Known devices and processes have not anticipated this invention since they relate to elementary devices and processes that at most allow making of piles without reinforcements (almost never used in practice) or complicated and involved systems incompatible with an economical making of piles.

A simple observation that none of these known devices has been seriously used is proof of this statement.

The process under consideration, without requiring abandonment of the form, eliminates the typical drawbacks of the so-called "jacketless" or unclad piles, i.e., having no outside metal covering, drawbacks such as slowness in execution and uncertainty of the continuity of the pile.

The following advantages are attained with the present invention:

making of the pile is remarkably fast, since the time for pull-out of the form is limited to the time necessary for pumping the volume of concrete required by the size of the pile itself;

reading of the pressure gauge that measures the air pressure in the chamber between the chuck and pipe form, a pressure due to the effect of introducing the concrete, an effect enhanced by the enlarging cylindrical sheath, guarantees the presence of pressure in the concrete during pull-out of the form and, therefore, guarantees the continuity of the pile, because it assures that the ground pressures are constantly opposed by the pressure of the concrete;

since pull-out of the form is facilitated by the thrust caused by the pressure of the concrete, the mechanical effort required for pull-out of the form is reduced and consequently the hoisting structure is lighter;

the pressure of the concrete causes a packing of the surrounding ground in inverse ratio to its consistency, thus increasing the lateral bearing capacity of the pile, both by the effect of packing the ground and by the consequent unevenness of the pile.

For greater clarity, the accompanying drawing shows in axial section a nonlimiting preferred embodiment of the device under consideration.

Most of the systems of piles which are driven and poured on site require the pipe form to remain completely clean during sinking.

This is very difficult to achieve at great depths and in the presence of marshy ground.

The solution of injecting concrete at the foot of the pipe form through a chuck makes the process completely immune to water infiltration.

The accompanying drawing is a somewhat schematic view of a device according to the invention.

With reference to the drawing, the device comprises:

a beating cap 1 provided with a conduit for introduction of the concrete under pressure;

a pipe form 3 to be sunk and pulled out gradually as the concrete is introduced. A pipe form provided with a connection 4 to a pressure gauge 4' for reading the pressure acting on the concrete;

a chuck 5 located within the pipe form 3, provided with conduit 2 for passage of the concrete under pressure and a cylindrical sheath 6 for reduction of volume;

two expandable tubular rings 7-7' to make a seal for the air under pressure in air chamber 8 between pipe forms 3 and chuck 5 and to achieve locking between chuck 5, pipe form 3 and beating cap 1;

a one-time bottom 9, located at that base of pipe form 3 to prevent penetration of dirt in the pipe form during sinking;

said bottom is provided with hooking elements 10 to hold reinforcement 11 of the concrete pile, a reinforcement placed between pipe form 3 and chuck 5, and to prevent the reinforcement from coming out during pull-out;

raising of pipe form 3 gradually as the concrete is introduced is facilitated by the pressure that is exerted in said air chamber (8) by the effect of the introduction of the concrete.

The process for using the device comprises the following operations:

the lower end of pipe form 3 rests on bottom 9 placed on the ground at the sinking point;

pipe form 3 is sunk by beating on the beating cap with an ordinary hammer until the depth desired for the foundation is reached;

tubular rings 7 are deflated and beating cap 1 is raised to the height necessary to allow insertion of reinforcement 11 of the concrete pile;

after insertion of reinforcement 11, beating cap 1 is put back in its original position and tubular rings 7, 7' are inflated;

pumping of the concrete is started and the pressure created in air chamber 8 between chuck 5 and pipe form 3 because of the reduction of the initial volume partially occupied by the concrete is read on the pressure gauge (4');

when the desired pressure is reached, pull-out of the pipe form begins, care being taken to follow the air pressure in said air chamber 8 on the pressure gauge and to keep said pressure within the desired limits, adjusting the speed of pull-out of pipe form 3 to the amount of concrete introduced;

when the pipe form is completely pulled out, the pile is complete and the cycle can begin again.

The device and process under consideration are based, therefore, on the following features:

the concept of using the compression of air enclosed between pipe form 3 and chuck 5 to find out, and almost visualize, the continuity of the pile (even in the phase of fast pull-out) guaranteed by the pressure read on pressure gauge 4';

the concept of using the imbalance between the area of the circular crown of the lower part of chuck 5 and that of the higher thicker part to increase the variation of the volumetric ratio and therefore of the pressure resulting from introduction of the concrete;

the mechanism for making the seal and locking between chuck 5', pipe form 3 and beating cap 1;

in general, the technical arrangements used to make an efficient and practical device.

It is provided that the shape of the various parts making up the device under consideration can vary, as long as they are compatible with what is claimed, without going outside the scope of protection of the patent.

What is claimed is:

1. An apparatus for making unclad concrete piles, comprising a beating cap having a conduit for the introduction of concrete under pressure, a pipe form to be sunk and pulled out gradually as the concrete is introduced, the pipe form having a connection to a pressure gauge for reading the pressures acting on the concrete, sealing means sealing between the beating cap and the pipe form to seal air under pressure within the pipe form, a bottom at the base of the pipe form to prevent dirt from penetrating into the pipe form during sinking, the bottom having securing means to hold reinforcement of the concrete pile, whereby the pipe form can be gradually raised as concrete is introduced and the air pressure within the pipe form rises due to the introduction of the concrete, the securing means preventing the reinforcement from rising with the pipe form.

2. Apparatus as claimed in claim 1, the sealing means being at least one expansible tubular sleeve.

3. Apparatus as claimed in claim 1, and a conduit for introduction of the concrete, the conduit extending downward within the pipe form substantially full length of the pipe form and rising with the pipe form when the pipe form is progressively raised.

4. A process for making unclad concrete piles, comprising placing a hollow pipe form on the ground at the desired location for the pile, hammering the pipe form into the ground with a bottom closing the pipe form, until the desired depth is reached, introducing concrete reinforcing means into the pipe form, sealing the top of the pipe form, pumping concrete into the pipe form until a predetermined pressure is reached within the pipe form by virtue of the introduction of the concrete into the sealed pipe form, and gradually raising the pipe form during introduction of further concrete while maintaining the air pressure in the pipe form above the concrete at about said predetermined pressure.

5. A process as claimed in claim 4, and securing said reinforcing means to said bottom before introducing the concrete.

6. A process as claimed in claim 4, and introducing the concrete through a conduit that extends down through the pipe form to the lower end of the pipe form, and raising the conduit gradually with the pipe form.

* * * * *